US006634130B1

(12) United States Patent
Balchunas

(10) Patent No.: US 6,634,130 B1
(45) Date of Patent: Oct. 21, 2003

(54) FIREARM LOCKING DEVICE

(76) Inventor: Curt Balchunas, 6 Calvin St., Ayer, MA (US) 01432

( * ) Notice: Subject to any disclaimer, the term of this patent is extended or adjusted under 35 U.S.C. 154(b) by 0 days.

(21) Appl. No.: 09/648,840

(22) Filed: Aug. 25, 2000

(51) Int. Cl.[7] ..... F41A 17/00
(52) U.S. Cl. ..... 42/70.11
(58) Field of Search ..... 42/70.11, 70.01

(56) References Cited

U.S. PATENT DOCUMENTS

| | | | | | |
|---|---|---|---|---|---|
| 4,969,284 | A | * | 11/1990 | Healey et al. | 137/38 |
| 5,048,211 | A | | 9/1991 | Hepp | 42/70.11 |
| 5,054,223 | A | | 10/1991 | Lee | 42/70.11 |
| 5,233,777 | A | * | 8/1993 | Waterman et al. | 42/70.11 |
| 5,289,653 | A | * | 3/1994 | Szebeni et al. | 42/70.11 |
| 5,398,438 | A | * | 3/1995 | Williams | 42/70.11 |
| 5,450,685 | A | * | 9/1995 | Peterson | 42/70.11 |
| 5,488,794 | A | * | 2/1996 | Arrequin | 42/66 |
| 5,664,358 | A | * | 9/1997 | Haber et al. | 42/44 |
| 5,890,310 | A | | 4/1999 | Bogstrom | 42/70.11 |
| 5,918,403 | A | | 7/1999 | Lurz, Jr. et al. | 42/70.11 |
| 5,950,344 | A | | 9/1999 | Ross | 42/70.11 |
| 6,041,536 | A | | 3/2000 | Samuels et al. | 42/70.11 |
| 6,202,336 | B1 | * | 3/2001 | Audino | 42/70.11 |
| 6,212,813 | B1 | * | 4/2001 | Luna et al. | 42/70.11 |

* cited by examiner

*Primary Examiner*—Michael J. Carone
*Assistant Examiner*—Denise J Buckley
(74) *Attorney, Agent, or Firm*—Nutter McClennen & Fish LLP

(57) ABSTRACT

The present invention discloses a device for locking firearms to prevent their discharge. The device is inserted into the barrel of a firearm and a locking element is inserted into the device to expand the diameter of at least a portion of the device. This causes a portion of the devices to be press or friction fit against the barrel of the firearm, thus locking the device and preventing discharge of the firearm. The device may also include a locking insert to which the locking element may be threadedly engaged in order to further ensure that the device is locked.

12 Claims, 6 Drawing Sheets

FIREARM LOCKING DEVICE

CROSS-REFERENCE TO RELATED APPLICATIONS

Not Applicable.

STATEMENT REGARDING FEDERALLY SPONSORED RESEARCH

Not Applicable.

FIELD OF THE INVENTION

The present invention relates generally to safety devices, and more particularly to a device for locking a firearm to prevent its discharge.

BACKGROUND OF THE INVENTION

Many individuals lawfully possess a firearm for reasons such as home protection, collecting, and sport. While firearms can be used safely by trained personnel, they can become dangerous and life-threatening when handled by those not trained or experienced in firearm operation. Realizing this, several states have mandated that all lawfully possessed firearms must be stored in a locked state via a locking device that prevents their use.

In response, many types of locking devices have been developed, all of which can be categorized as either external or internal, and all of which are problematic for various reasons.

External firearm locking devices are devices that, when in a locked state, are entirely or substantially visible when viewing the exterior of a firearm. The presence of external locking devices, such as the rifle lock disclosed in U.S. Pat. No. 4,813,252 to Ray and the trigger lock disclosed in U.S. Pat. No. 5,367,811 to Sansom, renders the locked firearm aesthetically unappealing, which is unacceptable for collectors who display their firearms. Moreover, their presence also hampers or entirely prevents the locked firearm from being stored in a fitted protective sleeve, holder or case. That, in turn, expedites the tarnishing or decay of the firearm, which also is unacceptable for collectors.

Internal firearm locking devices are devices that, when in a locked state, are entirely or substantially invisible when viewing the exterior of a firearm. Many internal locking devices consist of several separate, structurally-complex parts, making them cost prohibitive to manufacture and/or to sell. Moreover, this structural complexity can potentially inhibit or prevent a firearm owner from being able to safely and assuredly lock the firearm, and/or to quickly unlock the firearm. Examples of these types of structurally complex firearm locking devices are disclosed in U.S. Pat. Nos. 5,048,211 to Hepp, 5,054,223 to Lee, and 5,890,310 to Bogstrom.

Other types of internal firearm locking devices are problematic in that they are too easily unlockable from their locked state, even by small children. One example of such a device is disclosed in U.S. Pat. No. 5,918,403 to Lurz, Jr. et al. That device is engaged and disengaged via a screw head that protrudes from the barrel of the firearm. Such an arrangement allows for all-too-simple disengagement of the protruding screw head to unlock the device.

Yet another type of internal locking device disables a firearm from firing through the loading of a dummy cartridge in the firearm's barrel. Two examples of this type of locking device are disclosed in U.S. Pat. Nos. 5,950,344 to Ross, and 6,041,536 to Samuels et al. This type of locking device is usually loaded into the back end of the firearm barrel and then locked from the front end of the barrel, making the loading and locking process complex and time consuming.

Also problematic is the fact that many firearm locking devices, especially internal locking devices, are designed such that they may only lock one specific type of firearm, thus making their widespread manufacture cost prohibitive.

Therefore, a need exists for a firearm locking device that may be used on-different types of firearms, which may be quickly, easily and assuredly locked into place, yet also quickly and easily unlocked by its designated user(s), and which, when in a locked state, does not render a firearm aesthetically unappealing.

SUMMARY OF THE INVENTION

These needs, and others, are met by the present invention, which provides a firearm locking device. In one aspect of the invention, the firearm locking device is an elongate body with an open proximal end and a distal end. At least one slot extends from the proximal end toward the distal end to define a proximal slotted area and a distal unslotted area of the body. In a first, unlocked state, the body is substantially cylindrical, with a shape and diameter that enable it to be insertable into the barrel and chamber of a firearm. The device also includes a locking element that has a proximal end and a distal end and that is at least partially insertable into the proximal end of the elongate body and matable therewith. Once the locking element is inserted into the body, predetermined manipulation thereof is effective to mate the locking element with the body and to increase the diameter of the proximal slotted area of the body. This selective increase in the diameter of the body causes the proximal slotted area of the device to be press fit or friction fit against the barrel of the firearm, thus locking the device in place and preventing discharge of the firearm. Preferably, the body is able to be disposed within the barrel in a sub-flush condition.

In another aspect of the present invention, the elongate body of the firearm locking device includes at least three segments. The first, proximal segment has an open proximal end, an open distal end and a first bore extending longitudinally therethrough. The second, intermediate segment is located distal to the first segment and has an open proximal end, an open distal end and a second bore extending longitudinally therethrough. The first and second bores are substantially aligned about a longitudinal axis of the device while the device is in an unlocked state. The elongate body, in the embodiment, also includes a third segment that is located distal to the first and second segments, and that has an open proximal end. A locking element is insertable into the proximal end of the first segment such that the locking element extends through the first and second bores, and at least partially into the proximal end of the third element. Following insertion of the locking element, predetermined manipulation thereof is effective to misalign the first bore and the second bore. This manipulation also causes the second, intermediate segment of the body to be displaced out of alignment with the first and third segments and to be press fit or friction fit against the barrel of the firearm, thus locking the device in place and preventing discharge of the firearm.

In both embodiments of the present invention, the device generally further includes an insert, positioned within the distal, unslotted area of the body, through which the locking element is threaded in order to provide further assurance that the device is locked in place.

BRIEF DESCRIPTION OF THE DRAWINGS

The invention will be more fully understood from the following detailed description taken in conjunction with the accompanying drawings, in which.

DETAILED DESCRIPTION OF THE INVENTION

The present invention discloses a device for locking a firearm in order to prevent its discharge. For the sake of convenience, the term "firearm" is used herein to encompass all types, sizes, calibers, models, and modifications of automatic, semi-automatic, and non-automatic firearms.

Figure 1:
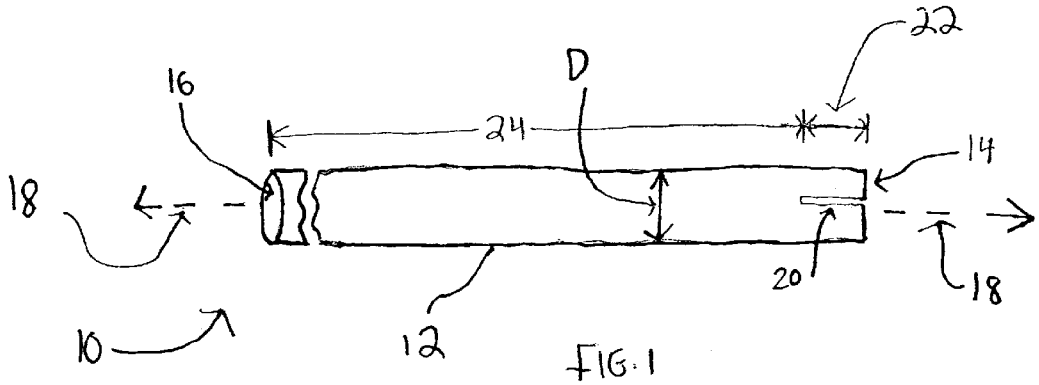
FIG. 1 is a side elevational view of a first embodiment of a firearm locking device in accordance with the present invention.

FIGS. 1–7 depict a first embodiment of the firearm locking device 10 of the present invention. As illustrated in FIG. 1, the device 10 has a body 12 with a proximal end 14 and a distal end 16. The body 12 is generally cylindrical and elongate and has a longitudinal axis 18. The device 10 also has at least one slot 20 that extends from the proximal end 14 toward the distal end 16 of the body 12. The presence of the slot(s) 20 defines a slotted area 22 and an unslotted area 24 of the body 12. The slot(s) 20 will be described in further detail below with reference to FIG. 5A.

Figure 2:
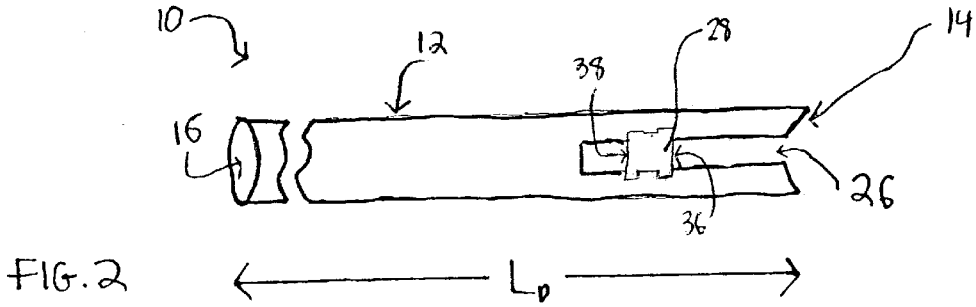
FIG. 2 is a side elevational, partially cut-away, view of the firearm locking device of FIG. 1.

As shown in FIG. 2, the proximal end 14 of the body 12 is open to define a receiving area 26 of the device 10 that receives a locking element 30. An exemplary locking element 30 (see FIG. 3) has a proximal end 32 and a distal end 34 that is sized to be introducable into the open proximal end 14 and the receiving area 26 of the body 12 as shown in FIG. 4.

Figure 3:
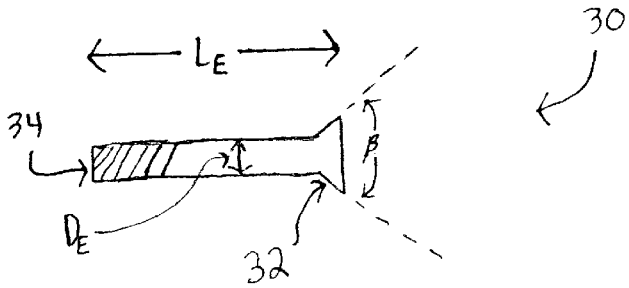
FIG. 3 is a side elevational view of a first embodiment of a locking element in accordance with the present invention.

In one embodiment of the present invention, the locking element 30 is a screw-like element, the proximal end 32 of which has a greater diameter than its distal end 34. In such an embodiment, the proximal end 32 of the locking element 30 is in the form of a screw head, while the distal end 34 of the locking element is in the form of a shaft that is at least partially threaded. As shown in FIG. 3, the diameter of the head portion 32 of the locking element 30 increases from a distal end of the head portion to a proximal end of the head portion. That is, the head portion 32 is angled from its distal end to its proximal end, wherein the angle $\beta$ is in the range of about 30° to 120°, preferably between 45° and 90°, most preferably approximately 60°.

In an embodiment in which the locking element is a screw-like element, the receiving area 26 is a substantially circular channel that is sized to allow for insertion of the locking element 30. One of ordinary skill in the art, however, will readily appreciate that the receiving area 26 may be differently shaped in order to receive a different type and/or shape of locking element 30.

Figure 4:
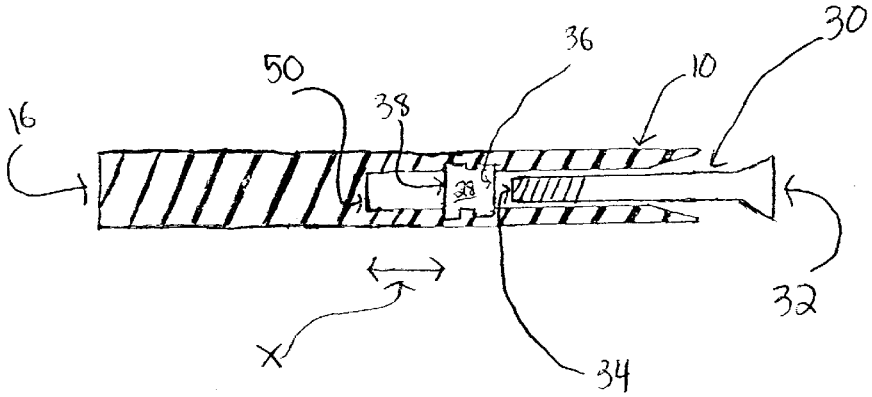
FIG. 4 is a sectional, side elevational view of the firearm locking device of FIG. 1 in a first, unlocked position with the locking element of FIG. 3 having been partially inserted therein

As shown in FIGS. 2 and 4, the device 10 generally also includes a locking insert 28 that is disposed within the receiving area 26 of the body 12. The insert 28 is molded, or otherwise secured, into the body 12 of the device 10 as is generally known in the art such that the insert is not unintentionally removable from the body. The locking insert 28 has a bore or passageway (not shown) that extends longitudinally from the proximal end 36 of the element to the distal end of the element. The passageway preferably includes a plurality of internal threads that are complimentary to threads on the distal end 34 of the locking element 30. The insert 28 may be knurled and/or it may have grooved sidewalls in order to further assure that it cannot be unintentionally dislodged from its predetermined position within the body 12 of the device 10.

One of ordinary skill in the art will appreciate that the firearm locking device 10 need not include a locking insert 28. In such an embodiment, the receiving area 26 preferably contains a plurality of internal screw threads such that the distal end of the locking element may be directly threaded into the receiving area of the device 10.

Figure 5:
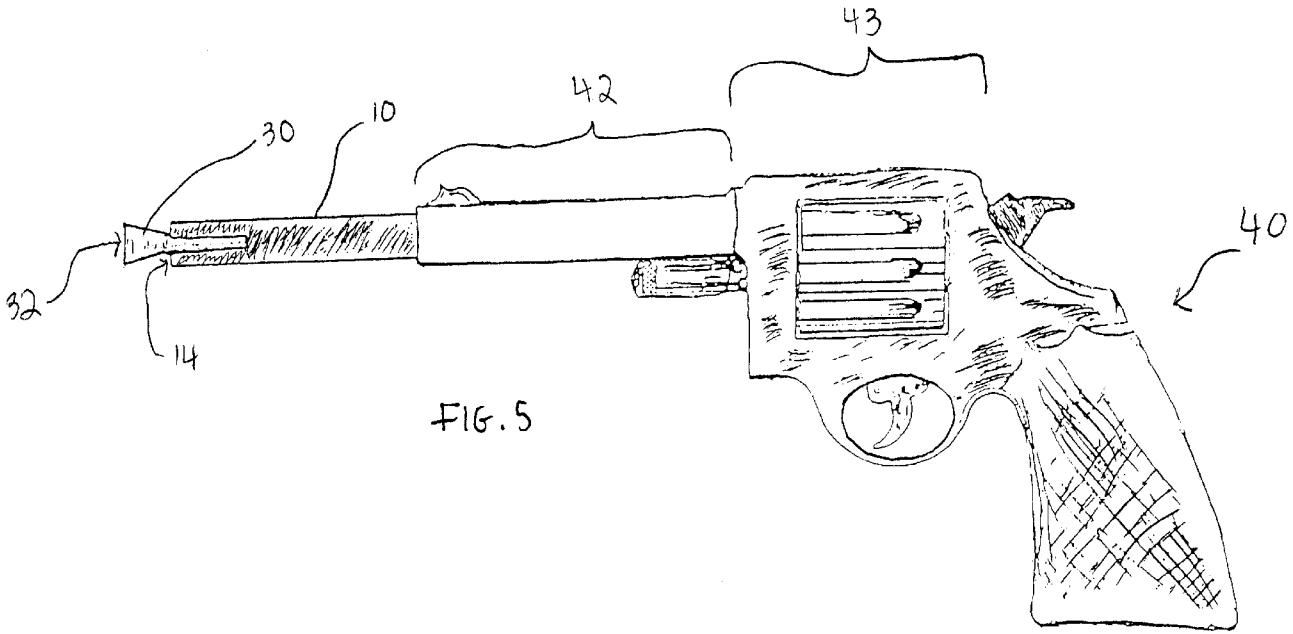
FIG. 5 is a side elevational view of a firearm during insertion of the locking device of FIG. 1 therein.

Referring now to FIG. 5, the locking device 10 is shown during its insertion into an exemplary firearm 40. The device 10 is inserted, distal end first, into and through the barrel 42 of a firearm 40 and then into the chamber 43 of the firearm 40. As shown in the exemplary embodiment of FIG. 5, the locking element 30 is partially contained within the receiving area 26 of the device 10 while the device is being inserted into the firearm 40. It is understood, however, that the device 10 also may be inserted into the firearm 40 without the locking element 30 being contained within the device.

Figure 5A:
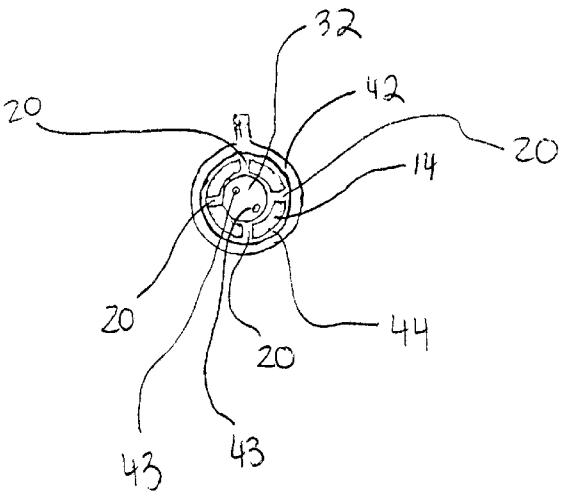
FIG. 5A is an end view of the barrel of the firearm of FIG. 5.

FIG. 5A depicts an end view of the barrel of the firearm 40 of FIG. 5. This view shows the proximal end 14 of the device 10, as well as the proximal end 32 of the locking element 30. The proximal end 32 of the locking element 30 may include one or more one recesses 43 to allow for the insertion of an object, such as a driver member or key (not shown), to manipulate the locking element into and through the receiving area 26 of the device 10. Although two recesses 43 are shown in FIG. 5A, it is understood that the number of recesses can be greater than, or less than, two.

Also shown in FIG. 5A are four slots 20 at the proximal end 14 of the device. As noted above with respect to FIG. 1, these slots 20 extend from the proximal end 14 of the device 10 toward the distal end 16 of the device to define a proximal, slotted area 22 and a distal, unslotted area 24 of the device. Preferably, the number of slots 20 included is even, and each slot is preferably diametrically opposed to another slot. One of ordinary skill in the art will readily appreciate, however, that the number of slots 20 present may be less than or greater than four and/or that the placement of the slots may differ from that shown in FIG. 5A without departing from the scope of the invention.

FIG. 5A also indicates the presence of a gap 44 between the proximal end 12 of the device 10 and the proximal end 32 of the locking element 30. The presence of this gap 44, in turn, indicates that the device 10 is in an unlocked state. The unlocked state is characterized in that the diameters D (see FIG. 1) of the slotted area 22 and the unslotted area 24 of the device 10 are substantially equal to each other.

Figure 6:
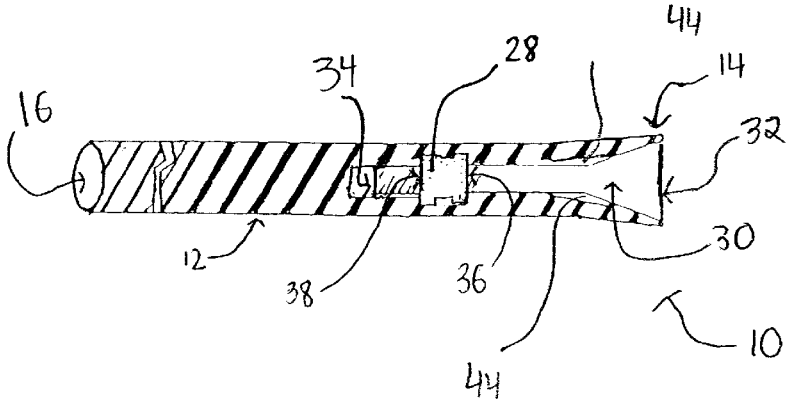
FIG. 6 is a sectional, side elevational view of the firearm locking device of FIG. 1 in a locked position with the locking element of FIG. 3 fully inserted therein.
Figure 7:
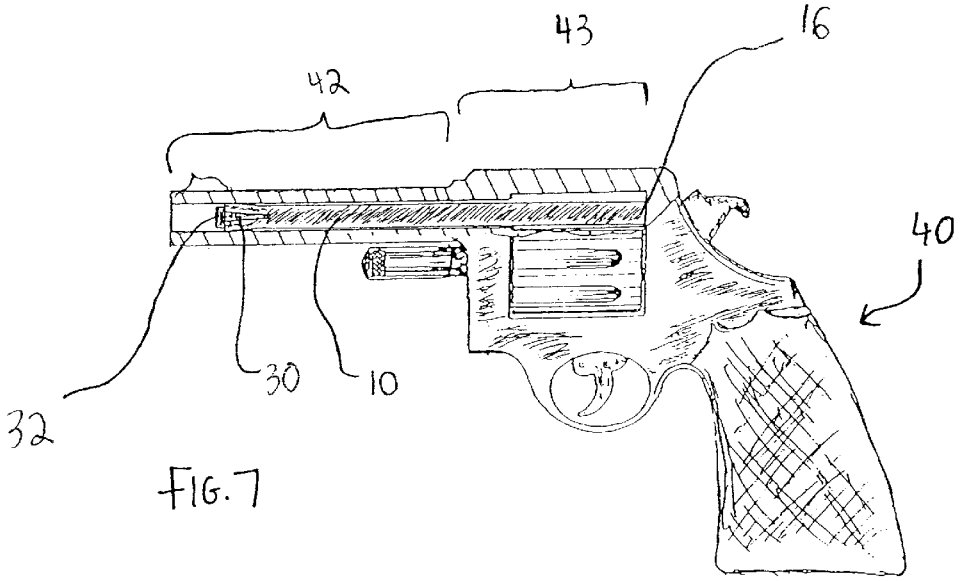
FIG. 7 is a side elevational, partially cut-away, view of the firearm of FIG. 5 following locking of the device of FIG. 1.
Figure 7A:
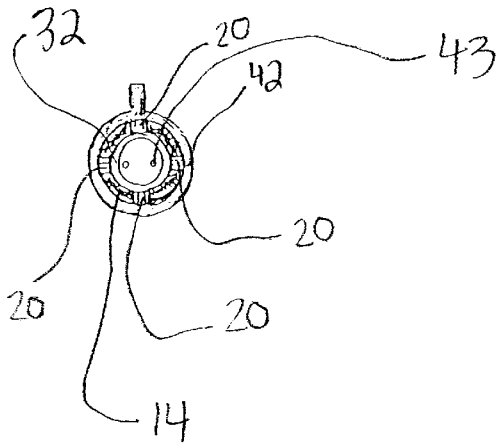
FIG. 7A is an end view of the barrel of the firearm of FIG. 7.

In contrast, FIGS. 6, 7 and 7A depict the device in a locked state. As shown in FIG. 6, the locked state of the device 10 is characterized by the proximal end 32 of the locking element 30 being completely disposed within the proximal end 14 of the elongate body 12 of the device, and by the distal end 34 of the locking element being distally advanced (i.e., threaded) though the passageway of the insert 28. As the proximal end 32 of the locking element 30 is forced into the body as such, the presence of the slots 20 allows the diameter of the slotted area 22 of the device 10 to increase in order to accommodate the proximal end 32 of the locking element 30.

As the diameter of the slotted area 22 is increased, the gap 44 between the barrel 42 of the firearm 40 and the slotted area 22 of the device 10 is reduced. Once the proximal end 32 of the locking element 30 has been completely inserted into the clearance area 26 of the device 10, the gap 44 is eliminated, and the device becomes locked against the wall of the barrel 42. The locked state of the device 10 is maintained due to the distal end 34 of the locking element 30 having been threaded through the insert 28. The threaded engagement between the locking element 30 and the insert 28 ensures that the proximal end 32 of the locking element will remain within the proximal end 14 of the body 12 of the device. This, in turn, ensures that the diameter of the slotted area 22 of the device 10 will remain increased, thus creating, and maintaining, a press or friction fit between the proximal end 14 of the device 10 and the barrel 42 of the firearm. The diameter of the unslotted area 24, as shown in FIG. 7, remains substantially constant during and after locking of the device 10.

As shown in FIG. 7, the device 10, while in a locked state, is preferably mounted sub-flush within the barrel 42 of the firearm 40, thus disguising its locked state. This sub-flush position also hinders unauthorized users, such as children, from attempting to unlock the device. One of ordinary skill in the art will readily appreciate, however, that the device 10, while in a locked state, may instead be mounted either substantially flush with the open end of the barrel 42 of the firearm, or mounted such that the at least a portion of the device protrudes from the open end of the barrel 42 of the firearm 40.

Although not shown, the device 10 is unlocked by reversing the steps required to lock the device. Specifically, the locking element 30 is removed (e.g., by a driver member or key) in a proximal direction, causing the distal end 34 of the locking element to first pass through the insert 28, and then through the remainder of the receiving area 26, until the locking element is completely removed from the device 10.

The firearm locking device 10 and the locking element 30 depicted in FIGS. 1–7 may have a variety of dimensions. Both the diameter D and the length $L_D$ (see FIGS. 1 and 2) of the device 10 are greater, respectively, than the diameter $D_E$ and length $L_E$ (see FIG. 3) of the locking element 30 but less, respectively, than the diameter and the combined lengths of the barrel 42 and the chamber 43 of the firearm 40. Specifically, the length $L_D$ of the device 10 should be in the range of about 10 millimeters to 40 millimeters less than the combined lengths of the barrel 42 and the chamber 43 of the firearm 40, while the diameter D of the device 10 should be in the range of about 0.05 millimeter to 0.5 millimeter less than the diameter of the barrel 42 of the firearm 40.

The length $L_E$ and diameter $D_E$ of the locking element 30 will generally vary depending on the length and/or caliber of the firearm 40. For example, in an embodiment wherein the locking element 30 is a screw, the size of the screw will vary depending on the caliber of the firearm 40. If the firearm 40 is 357 caliber, for example, the locking element 30 may be a #10 size standard screw, while if the firearm is thirty caliber, the locking element may be a #8 size standard screw. If, instead, the firearm 40 is forty-four caliber, the locking element 30 may be a ¼–20 size standard screw.

The insert 28 preferably is molded into the clearance area 26 such that the distal end 34 of the locking element 30 can be threaded through the insert. To allow this, the distal end 34 of the insert 28 lies a distance X (see FIG. 4) in the range of about 6 millimeters to 8 millimeters from the distal end 50 of the clearance area 26.

As indicated above, at least one slot 20 extends from the proximal end 12 of the device 10 toward the distal end 14 of the device. Generally, the amount 22 (see FIG. 1) that each slot 20 so extends is in the range of about 10 millimeters to 50 millimeters. Preferably, each slot 20 extends substantially the same distance from the proximal end 12 of the device 10 toward the distal end 14 of the device; however, one of ordinary skill in the art will readily appreciate that one, some, or all of the slots 20 may extend different amounts from the proximal end 12 toward the distal end 14 of the device.

FIGS. 8–14 depict an alternate embodiment of the firearm locking device 100 of the present invention. In the exemplary embodiment of FIG. 8, the device 100 includes three segments, a first, proximal segment 102, a second, intermediate segment 104 located distal to the proximal segment, and a third, distal segment 106 located distal to both the first and middle segments. One of ordinary skill in the art will readily appreciate that the number of segments may be greater than, or less than, three without departing from the scope of the invention.

Each segment 102, 104, 106, has a proximal end 108, 110, 112 and a distal end 114, 116, 118. The proximal and distal ends 108, 114 of the first segment 102 are both open and communicate with a first bore 120 that extends longitudinally through the first segment (see FIG. 9). Likewise, the proximal and distal ends 110, 116 of the intermediate segment 104 are open and communicate with a second bore 122 that extends longitudinally through the intermediate segment. The proximal end 112 of the third segment 106 includes a third bore 124 that extends at least partially into the third segment. In one embodiment, the third bore 124 extends longitudinally through the entirety of the third segment 106. However, it is also possible that the third bore is a blind bore that extends only partially through the third segment 106.

The segments 102, 104, 106 of the device 100 are capable of being aligned to receive a locking element 130, and when so aligned the segments bores 120, 122, 124 are likewise aligned. An exemplary locking element 130 (see FIG. 10) has a proximal end 132 and a distal end 134. In one embodiment of the present invention, the locking element 130 is a screw-like element with its proximal end 132 in the form of a screw head and its distal end 134 in the form of a shaft that is at least partially threaded. In such an embodiment, each of the bores 120, 122, 124 is a substantially cylindrical channel that is sized to be alignable with the other bores and to receive the screw-like locking element 130. One of ordinary skill in the art, however, will readily appreciate that the one, some, or all of the bores 120, 122, 124 may be differently shaped in order to receive a different type and/or shape of locking element 130.

Figure 9:
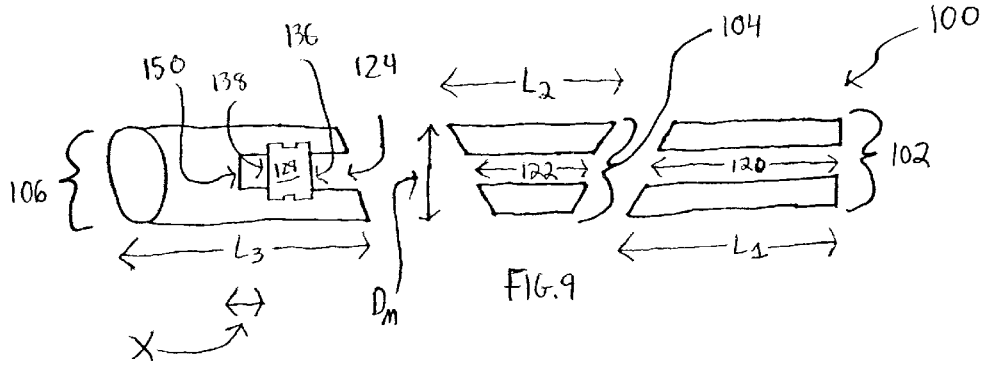
FIG. 9 is a partially cut-away, exploded side elevational view of the firearm locking device of FIG. 8.
Figure 10:
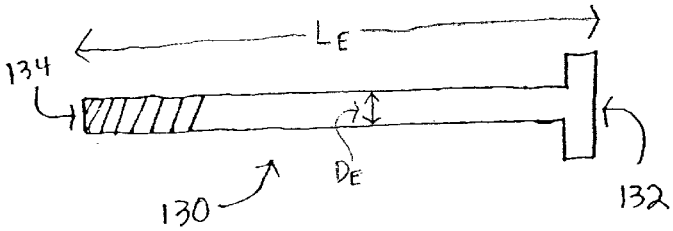
FIG. 10 is a side elevational view of another embodiment of a locking element in accordance with the present invention.
Figure 11:
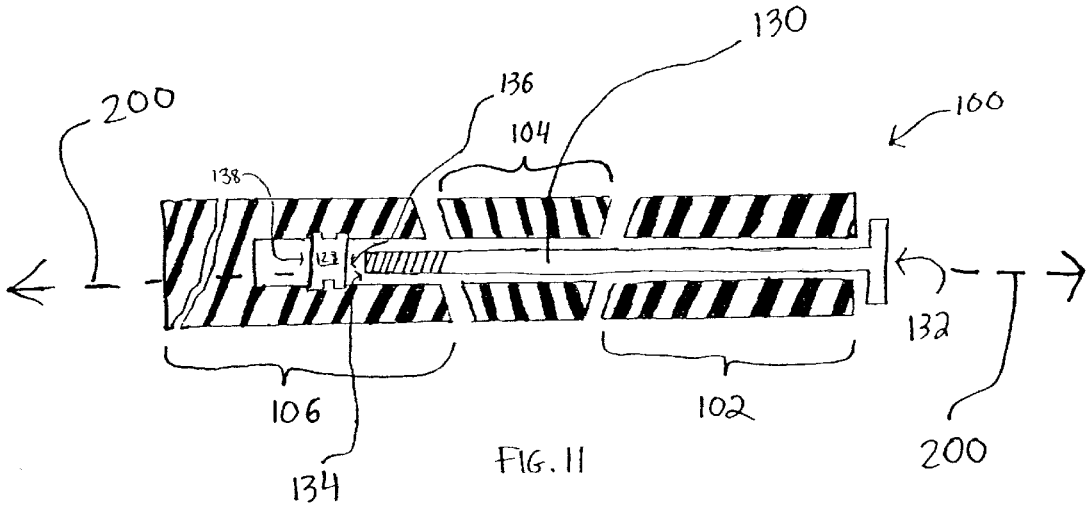
FIG. 11 is a sectional, side elevational view of the firearm locking device of FIG. 8 in an unlocked position with the locking element of FIG. 10 partially inserted therein.

As shown in FIGS. 9 and 11, the device 100 also generally includes a locking insert 128 that is molded, or otherwise secured, into the distalmost segment 106 of the device as is generally known in the art such that the insert is not unintentionally removable from the body. The locking insert 128 has a bore or passageway (not shown) that extends longitudinally from the proximal end 136 of the insert to the distal end 138 of the insert. The passageway preferably includes internal threads that are complimentary to threads on the distal end 134 of the locking element 130 may be threaded through the insert 128. The insert 128 may be knurled and/or it may have grooved sidewalls in order to further assure that it is not unintentionally removable from within the device 100.

Figure 8:
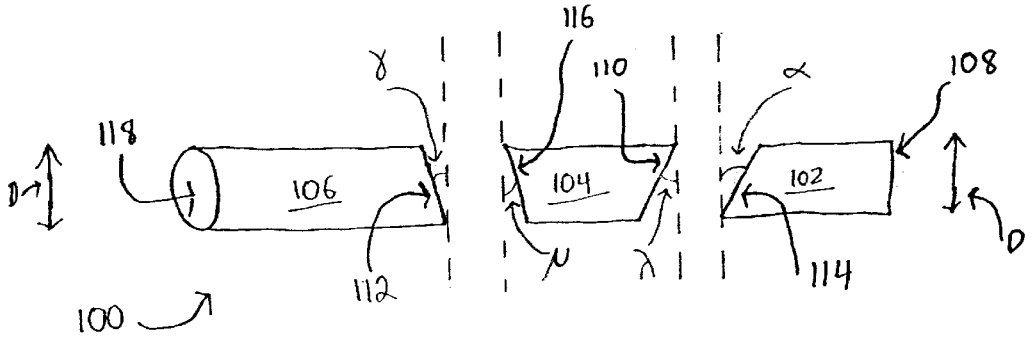
FIG. 8 is an exploded, side elevational view of another embodiment of a firearm locking device in,accordance with the present invention.

In an exemplary embodiment of the present invention, the abutting ends 110, 112, 114, 116 of each of the first, second and third segments 102, 104, 106 are beveled. The beveled ends 110, 112, 114, 116 of each segment 102, 104, 106 should be complimentary such that, in a first, unlocked state, all of the segments are substantially coaxially aligned. Specifically, as shown in FIG. 8, the distal end 114 of the first segment 102 is beveled at an angle a with respect to vertical, the proximal and distal ends 110, 116 of the second segment 104 are beveled at angles $\lambda$ and $\mu$ with respect to vertical, and the proximal end 112 of the third segment 106 is beveled at an angle $\gamma$ with respect to vertical.

Exemplary values for the angles $\alpha$, $\gamma$ $\lambda$,and $\mu$ are in the range of about 450 to 75°, preferably between 55° and 650. The values of the angles $\alpha$, $\gamma$ $\lambda$, and $\mu$ may be substantially equal; in such an embodiment, the values of each of the angles $\alpha$, $\gamma$ $\lambda$, and $\mu$ is preferably approximately 60°.

Figure 12:
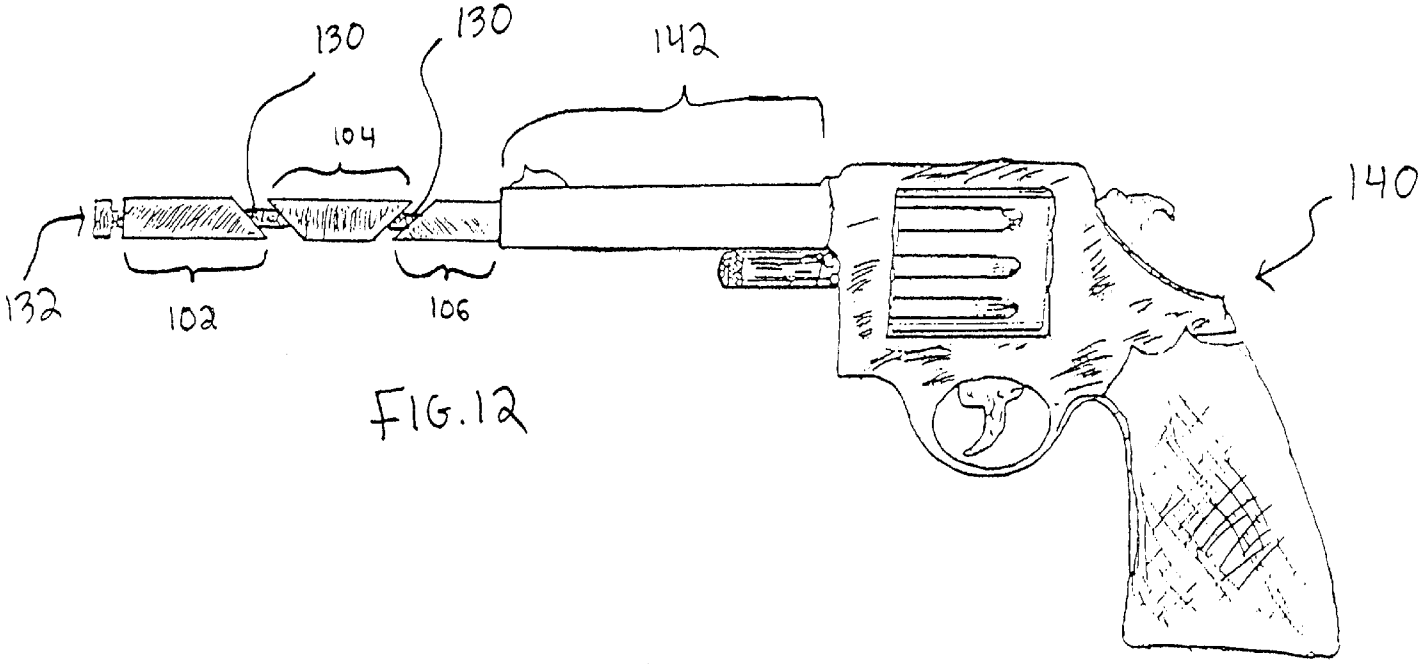
FIG. 12 is a side elevational view of a firearm during insertion of the locking device of FIG. 8 therein.

Referring now to FIG. 12, the locking device 100 is shown during its insertion into a firearm 140. As shown in FIG. 12, the locking element 130 has been inserted into the bores 120, 122, 124 of the first, second and third segments 102, 104, 106 of the device 100 prior to the device being inserted into the firearm 140. It is understood, however, that the one, some, or all of the segments 102, 104, 106 of the device 100 may be inserted into the firearm 140 without the locking element 130 having been inserted therewithin.

Figure 12A:
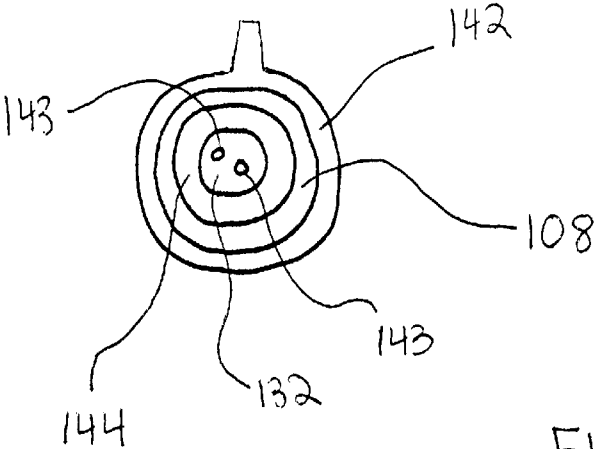
FIG. 12A is an end view of the barrel of the firearm of FIG. 12.

FIG. 12A depicts an end view of the barrel 142 of the firearm 140 of FIG. 12. This view shows the proximal end 108 of the first segment 102 of the device 10 and the proximal end 132 of the locking element 130. The proximal end 132 of the locking element 130 can include one or more one recesses 143 to allow for the insertion of an object, such as a driver member or key (not shown), to manipulate the position of the locking element. Although two recesses 143 are shown in FIG. 12A, it is understood that the number of recesses may be greater than, or less than, two. FIG. 12A also depicts a gap 144 between the proximal end 108 of the first segment 102 of the device 100 and the proximal end 132 of the locking element 130. The presence of this gap 144 indicates that the device 100 is in an unlocked state.

Figure 13:
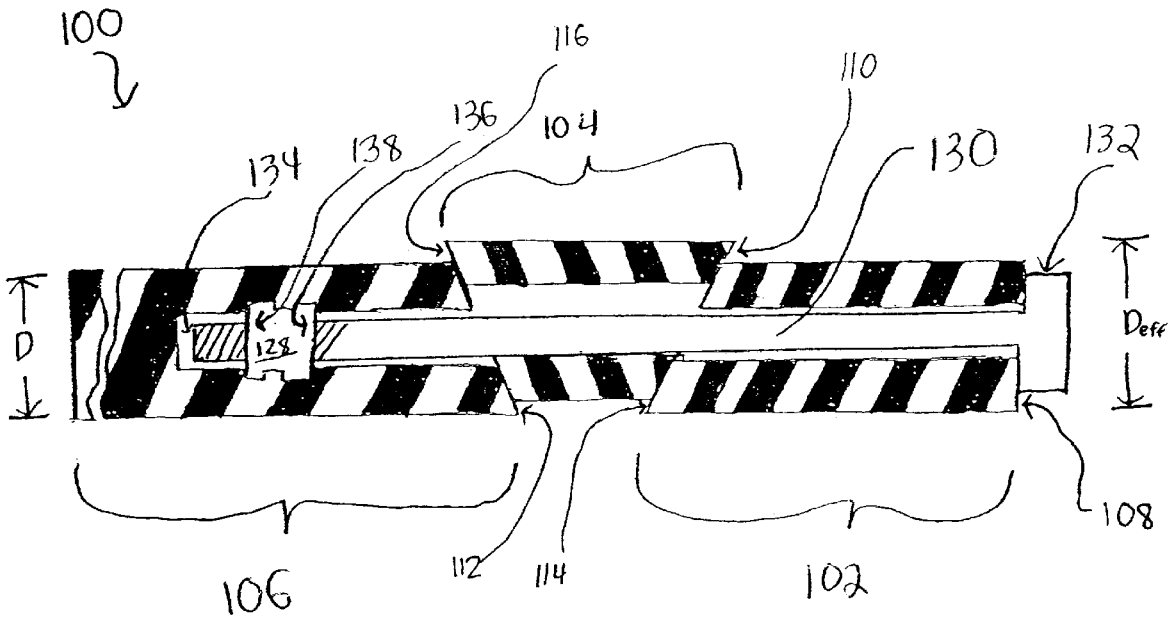
FIG. 13 is a sectional, side elevational view of the firearm locking device of FIG. 8 in a locked position with the locking element of FIG. 10 inserted therein.
Figure 14:
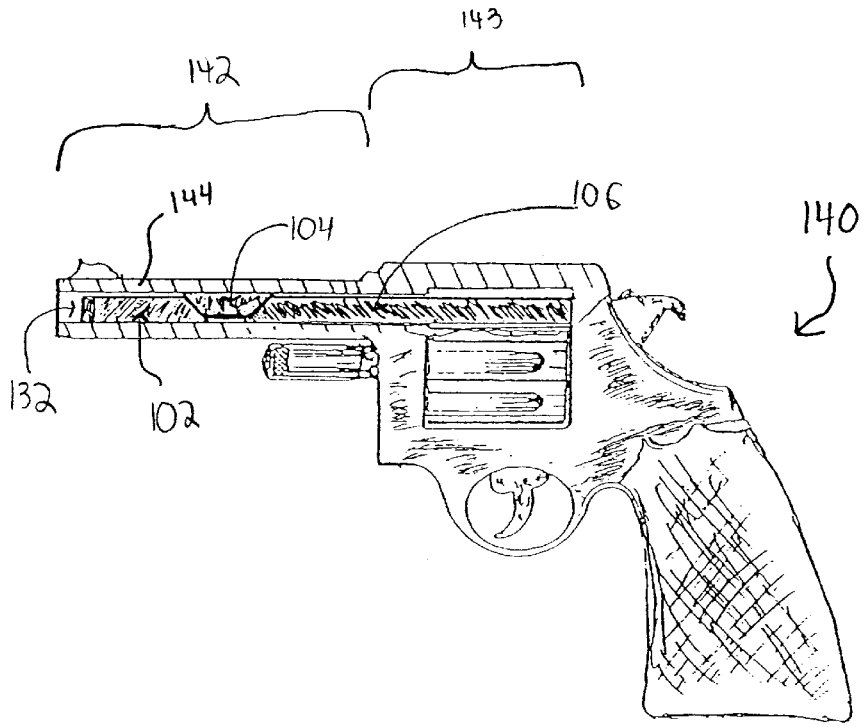
FIG. 14 is a side elevational, partially cut-away, view of the firearm of FIG. 12 following locking of the device of FIG. 8.

In contrast, FIGS. 13 and 14 illustrate the device 100 in a locked state. To achieve this locked state, the locking element 130 is distally advanced through the first and second bores 120, 122 and into the third bore 124 until the distal end 134 of the locking element is at least partially threaded into, or otherwise secured within, the insert 128. Because the locking element 130 has a length less than the length of the device 100, and the diameter of the proximal end 132 of the locking element is greater than the diameter of the first bore 120 of the first segment, at some point after the distal end 134 of the locking element 130 has distally advanced beyond (i.e., has been partially threaded into) the proximal end 136 of the insert 128, the proximal end 132 of the locking element will contact the proximal end 108 of the first segment 102 of the device.

To actually lock the device 100 within the firearm 140, the locking element 130 must be further distally advanced within the device 100. This further distal advancement is effected by distally threading the distal end 134 of the locking element 130 into, and though, the insert 128. As this occurs, the proximal end 132 of the locking element 130 (or screw head) compresses the three segments 102, 104, 106. This compressive force causes the intermediate segment 104 to become slightly misaligned with segments 102 and 106. That is, the abutting angular ends 110 and 114 of the first and second segments 102, 104 and 112, 116 of the second and third segment 104, 106 cause the intermediate segment 104 to ride up the ramps created by the angular ends of the segments, as shown in FIG. 13.

As shown in FIG. 14, the second, intermediate segment 104 of the device has been displaced with respect to segments 102 and 106, as discussed above, such that a top portion thereof is press fit or friction fit against the upper portion 144 of the barrel 142 of the firearm, thus locking the device 100 and preventing discharge of the firearm 140. The locked state of the device 10 is maintained due to the distal end 134 of the locking element 130 having been threaded through the insert 128. This maintains the distal force being exerted by the proximal end 132 of the locking element 130 against the proximal end 108 of the first segment 102, thus ensuring that the second segment 104 remains displaced against the barrel 142 of the firearm 140. While in the locked state, the device 10 has an effective diameter, DC, that is greater than the diameter, D, of the device in its unlocked state.

FIG. 14 further illustrates that, like the device of FIGS. 1–7 , the device 100 of FIGS. 8–14, while in a locked state, is preferably mounted sub-flush within the barrel 142 of the firearm 140, thus disguising its locked state. This sub-flush position also hinders unauthorized users, such as children, from attempting to unlock the device. One of ordinary skill in the art will readily appreciate, however, that the device 100, while in a locked state, may instead be mounted either substantially flush with the open end of the barrel 142 of the firearm 140, or mounted such that the at least a portion of the device protrudes from the open end of the barrel of the firearm.

Although not shown, the device 100 is unlocked by reversing the steps required to lock the device. Specifically, the locking element 130 is removed (e.g., by a driver member or key) in a proximal direction, causing the distal end 134 of the locking element to pass through the insert 128, and then through each of the bores 120, 122, 124, until the locking element is completely removed from the device 10. This causes the second segment 104 of the device 100 to realign with the first and third segments 102, 106 of the device.

The firearm locking device 100 and the locking element 130 may have a variety of dimensions. As shown in FIG. 9, the first, second and third segments 102, 104, 106 have lengths $L_1$, $L_2$, $L_3$, the sum of which, as shown in FIG. 14, should be less than the combined lengths of the barrel 142 and the chamber 143 of the firearm 140, preferably by a distance in the range of about 10 millimeters to 40 millimeters. Generally, each of the lengths $L_1$, and $L_3$ is greater than the length $L_2$.

In one embodiment of the device 100 of FIGS. 8–14, the length $L_3$ of the third segment 106 may be reduced, e.g., cut down by an end-user, as appropriate in order to allow the device to be able to locked within any firearm with a smaller length barrel 142 and/or chamber 143. In such an embodiment, the third segment 106 would preferably bear one or more external, visible marking s to indicate the points at which the third segment should be cut down in order to fit within various types and calibers of firearms.

The segments 102 and 106 generally have the identical diameters D (see FIG. 8) in the range of about 0.3 millimeter to 0.4 millimeter less than the diameter of the barrel 142 of the firearm 140. The segment 104, generally has a diameter $D_M$ (see FIG. 9) that is in the range of about 1 millimeter to 1.5 millimeters less than the diameter D of the segments 102 and 106. The bores 120, 124 in each of the segments 102, 106 also generally have identical diameters, while the bore 122 in segment 104 has a diameter that is in the range of about 1.5 millimeters to 2 millimeters greater than the diameters of bore 120 and 124.

The device 100 has a diameter, D that is equal to the diameter of segments 102, 106 while in its unlocked state. In contrast, as shown in FIG. 13, the device 100 has an effective diameter, $D_{eff}$, that is greater than D, preferably by about 1 millimeter to 3 millimeters.

The locking element 130 has a length $L_E$ and a diameter $D_E$. The length $L_E$ of the locking element is greater than the sum of the lengths $L_1$, $L_2$ of the first and second segments of the device 102, 104 of the device 100, but less than the sum of the lengths $L_1$, $L_2$, and $L_3$ of the first, second and third segments 102, 104, 106 of the device. Generally, the length $L_E$ of the locking element 130 is greater than the sum of the lengths $L_1$ and $L_2$ by a distance in the range of about 10 millimeters to 40 millimeters.

The diameter $D_E$ of the locking element 130 will generally vary depending on the caliber of the firearm 140. For example, in an embodiment wherein the locking element 130 is a screw, the size of the screw will vary depending on the caliber of the firearm 140. If the firearm 140 is 357 caliber, for example, the locking element 130 may be a #10 size standard screw, while if the firearm is thirty caliber, the locking element may be a #8 size standard screw. If, instead, the firearm 140 is forty-four caliber, the locking element 130 may be a ¼–20 size standard screw.

The insert 128 preferably is molded into the third segment 106 such that the distal end 134 of the locking element 130 can be threaded through the insert. In order to allow this, the distal end 138 of the insert 128 lies a distance X (see FIG. 9) in the range of about 6 millimeters to 8 millimeters from the distal end 150 of the third bore 124.

One having ordinary skill in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A firearm locking device, comprising:

a unitary, elongate body having a distal end and an open proximal end that defines a receiving area of the elongate body;

at least one slot extending through an outer wall of the elongate body from an end wall of the proximal end toward the distal end to define a slotted area of the elongate body and an unslotted area of the elongate body, the slotted area and unslotted area having substantially equal diameters when the elongate body is in an unlocked state;

a locking insert disposed within the receiving area of the body, the locking insert having an external geometry, including at least one groove, enabling the locking insert to be secured within the body, and an internally threaded passageway that is effective to receive a locking element; and a locking element having proximal and distal ends, the locking element being at least partially insertable within the passageway of the locking insert such that predetermined manipulation of the locking element relative to the locking insert is effective to increase the diameter of the slotted area of the elongate body and place the elongate body in a locked state.

2. The device of claim 1, wherein the distal end of the locking element is threaded, and wherein the passageway of the locking insert has internal threads complimentary to threads of the locking element.

3. The device of claim 1, wherein an even number of slots extend from the proximal end of the body toward the distal end of the body.

4. The device of claim 3, wherein four slots extend from the proximal end of the body toward the distal end of the body.

5. The device of claim 3, wherein each slot is diametrically opposed to another slot.

6. The device of claim 1, wherein the elongate body is generally cylindrical.

7. The firearm locking device of claim 6, wherein the elongate body has a first length, the locking element has a second length and a second diameter, and the barrel of the firearm has a third length and a third diameter, the first length being greater than the second length but less than the third length and the diameter of the elongate body being greater than the second diameter but less than the third diameter.

8. The firearm locking device of claim 7, wherein the third length is greater than the first length by a distance in the range of between about 10 millimeters and 40 millimeters and the first length is greater than the second length by a distance in the range of about 6 millimeters to 8 millimeters.

9. The firearm locking device of claim 7, wherein the third diameter is greater than the diameter of the elongate body by a distance in the range of about 0.05 millimeter to 0.5 millimeter and the and the diameter of the elongate body is greater than the second diameter by a distance in the range of about 1 millimeter to 2.5 millimeters.

10. The device of claim 1, wherein the proximal end of the locking element has a first diameter and the distal end of the locking element has a second diameter, the first diameter being greater than the second diameter.

11. A firearm locking device, comprising:

a generally cylindrical elongate, unitary body having a blind bore formed therein and extending from a proximal end of the elongate body toward a distal end of the elongate body, the elongate body having a first, uniform diameter in an unlocked position that enables the entire elongate body to be placed within a barrel of a firearm in a clearance fit;

at least one slot formed through an outer wall of the elongate body and extending from an end wall of the proximal end of the elongate body toward the distal end of the elongate body to define a slotted, proximal area and an unslotted, distal area of the elongate body; and a locking insert disposed within a portion of the slotted area of the body, the locking insert having an external geometry, including at least one groove, enabling the locking insert to be secured within the body, and an internally threaded passageway that is effective to receive a locking element; and a locking element having a proximal end with a head portion that has a diameter greater than that of a distal end of the locking element, the locking element being at least partially insertable within the receiving area of the elongate body such that further distal advancement of the locking element within the elongate body causes the head portion to abut the slotted area of the elongate body to increase the diameter of a portion of the elongate body to a second diameter that is sufficient to produce an interference fit between the slotted area of the elongate body and the barrel of the firearm.

12. The device of claim 11, wherein the head portion of the locking element has a diameter that increases from a distal end of the head portion to a proximal end of the head portion.

* * * * *